United States Patent [19]

Blom et al.

[11] Patent Number: 4,861,446

[45] Date of Patent: Aug. 29, 1989

[54] TREATMENT OF GAS LIQUOR

[75] Inventors: Peter W. E. Blom, Verneeniging; Johann H. Wingard, Johannesburg, both of South Africa

[73] Assignees: The Union Steel Corporation of South Africa Limited, Vereeniging; Edward L. Bateman Limited, Boksburg, both of South Africa

[21] Appl. No.: 293,612

[22] Filed: Jan. 5, 1989

Related U.S. Application Data

[63] Continuation of Ser. No. 108,696, Oct. 15, 1987, abandoned.

[30] Foreign Application Priority Data

Oct. 16, 1986 [ZA] South Africa ..... 87/7844

[51] Int. Cl.[4] ..... C07C 3/24

[52] U.S. Cl. ..... 204/170

[58] Field of Search ..... 204/170, 173

[56] References Cited

U.S. PATENT DOCUMENTS 2,000,224 5/1935 Eisenhut ..... 204/170

4,606,761 8/1986 deWaal ..... 75/10.19

*Primary Examiner*—T. M. Tufariello

*Attorney, Agent, or Firm*—Finnegan, Henderson, Farabow, Garrett & Dunner

[57] ABSTRACT

A method and apparatus for converting a raw gas such as the gas liquor resulting from a Lurgi-type coal gasification process together with $CO_2$ and/or water by passing it through a plasma arc heater and gas converter to convert it to a mixture of CO and $H_2$.

12 Claims, No Drawings

TREATMENT OF GAS LIQUOR

This application is a continuation, of application Ser. No. 108,696, filed Oct. 15, 1987, now abandoned.

This invention relates to the treatment of raw gas, particularly one such as that comprising the gas liquor resulting from the conversion of a solid carbonaceous compound, such as coal, for example, to a liquid and/or gaseous product. One such conversion, well known in the art, comprises the so called Lurgi-process for the gassification of coal.

The raw gas or gas liquor resulting from the aforesaid type of conversions is usually characterised by the fact that, apart from a gaseous hydrocarbon content (in the case of the Lurgi-process mainly $CH_4$ in the order of 13–14%), and other useful gases such as CO and $H_2$, it also contains a relatively high percentage of unwanted gases, such as $CO_2$; certain other volatiles such as benzene, toluene, phenols, and certain oils; as well as cresoles, tars and pitches which have to be removed from the wanted gaseous component before the latter can be utilized in other processes, such as, for example, as a synthesis gas in the production of liquid petroleum fuel. In the rest of the specification the phrase "raw gas" means a fluid from a coal gassification process containing a hydrocarbon or carbonaceous component and at least one of the compounds $H_2$, CO, $CO_2$, $H_2O$, benzene, toluene, phenols, organic oils, cresoles, tars, pitches.

Usually such separation of the gaseous components from the less volatile components entails the treatment of the raw gas or gas liquor with large quantities of water, and one of the cost inhibiting factors associated with the conventional gas conversion process is related to the disposal and/or treatment of such waste waters.

It is accordingly an object of this invention to provide a method and means with which the aforesaid problem may be overcome or at least minimized.

According to the invention a method is provided for treating a raw gas such as the gas liquor resulting from the conversion of a carbonaceous compound, such as coal for example, to a liquid and/or gaseous component, or a raw gas of similar constitution obtained elsewhere, the method including the step of passing at least part of such raw gas through a plasma arc heater to convert at least part of the carbonaceous component present therein, together with the $CO_2$ and/or water vapour present therein, or added thereto, to a mixture of CO and $H_2$.

It will be appreciated that the gas mixture of CO and $H_2$ resulting from the method according to the invention may be utilized in the synthesis of a variety of products, such as liquid petroleum, for example.

It will be appreciated further that by so converting at least some of the less volatile carbonaceous compounds in the raw gas or gas liquor to other components, the amount of unwanted product which ultimately has to be removed through a suitable water wash treatment from the end product is reduced, which, of course, results in a corresponding reduction in the waste water disposal problem referred to above.

Also, because at least part of any $CO_2$ present in the gas liquor may also be utilised in the conversion reaction, an end product can result which contains less of the unwanted $CO_2$.

Any solids and/or unwanted heavy components present in the gas mixture resulting from the conversion according to the invention may be removed from it in any suitable manner such as by means of a suitable scrubbing process, for example.

Such components may, however, also be removed at least partly by subjecting the converted gas mixture to further conversions via a plasma arc heater in a method similar to that described above.

The aforesaid conversions are preferably allowed to proceed, or at least to be completed, in a gas conversion reaction chamber located downstream of the plasma arc heater.

Because the resulting converted gas mixture passing from such a converter is at a substantially high temperature (usually in excess of 1000° C.), it has to be cooled before it can be utilised further, and this can be effected by passing it through a suitable water body.

It will be appreciated that any steam which will form as a result of this can usually find useful application in some of the other processes of the particular plant.

In a preferred form of the invention the method is carried out on a raw gas stream obtained from a Lurgi-type coal gassification process.

Preferably a 8.5 megawatt plasma arc heater is employed and preferably three of these, together with three gas converters, are employed.

The gas converter is furthermore preferably lined on its inside with special brick work which is resistant to high temperatures and thermal shocks.

Preferably the gas converter has an effective L/D ratio (the ratio between effective length and inside diameter) which varies between approximately 5/1 and 10/1, preferably 7/1.

Further according to the invention the gas converter is connected to the plasma arc heater by means of a sliding valve.

Such a valve not only serves to facilitate the replacement of the electrodes in the plasma arc heater, but it also serves to isolate the gas converter from the rest of the apparatus.

Applicant has found that the plasma arc heater in the method according to the invention has a thermal efficiency of at least 88%, and that a chemical efficiency of as high as 95% is possible in the method of the invention.

The utilization of a method and apparatus of the aforesaid kind in the treatment of raw gas obtained from a Lurgi-type coal gassification plant, give rise to an increase in the order of between 18–22% in the amount of synthesis gas produced. Apart from this, the utilization of such a method in a conventional type of Lurgi-process also give rise to a substantial saving in capital expenditure because of the employment of less elaborate, and hence expensive, gas cleaning apparatus.

It will be appreciated that also intended for inclusion in the scope of this invention is apparatus as herein described suitable for use in the method of this invention.

It will be appreciated further that there are no doubt many variations in detail possible with a method and apparatus according to the invention without departing from the scope of the appended claims.

We claim:

1. A method for treating a raw gas containing a carbonaceous component resulting from a coal gassification process to increase its CO and $H_2$ content comprising passing said raw gas through a plasma arc heater in the presence of $CO_2$ and $H_2$to convert at least part of the carbonaceous component therein to a mixture of CO and $H_2$.

2. The method of claim 1 including the further step of removing by a scrubbing process an unwanted heavy component present in the gas mixture resulting from the conversion.

3. The method of claim 1, wherein any unwanted heavy components present in the gas mixture resulting from the conversion are removed at least partly by subjecting the converted gas mixture to further conversions with a plasma arc heater.

4. The method of claim 1, wherein the conversion is completed in a gas conversion reaction chamber located downstream of the plasma arc heater.

5. The method of claim 4, including the further step of cooling the resulting converted gas mixture from the converter by passing it through water.

6. The method of claim 1, wherein the raw gas is the gas liquor from a Lurgi-type coal gassification process.

7. The method of claim 4, wherein the plasma arc heater has a capacity of 8.5 megawatt.

8. The method of claim 7, wherein at least three combinations of plasma arc heater and gas converters are employed.

9. The method of claim 7, wherein the gas converter is lined on its inside with brick which is resistant to high temperatures and thermal shocks.

10. The method of claim 7, wherein the gas converter has an effective L/D ratio which varies between 5/1 and 10/1.

11. The method of claim 7, wherein the gas converter has an effective L/D ratio of 7:1.

12. The method of claim 7, wherein the gas converter is connected to its associated plasma arc heater by a sliding valve.

* * * * *

UNITED STATES PATENT AND TRADEMARK OFFICE

CERTIFICATE OF CORRECTION

PATENT NO. : 4,861,446

DATED : August 29, 1989

INVENTOR(S) : Peter W. E. Blom et al.

It is certified that error appears in the above-identified patent and that said Letters Patent is hereby corrected as shown below:

Claim 1, column 2, line 68 -- "$H_2$to" should be --$H_2O$ to --.

Signed and Sealed this

Sixteenth Day of October, 1990

*Attest:*

HARRY F. MANBECK, JR.

*Attesting Officer*

*Commissioner of Patents and Trademarks*